US005125320A

United States Patent [19]

Zielinski

[11] Patent Number: 5,125,320

[45] Date of Patent: Jun. 30, 1992

[54] LIQUID PROPELLANT CANNON

[75] Inventor: Erich Zielinski, Düsseldorf, Fed. Rep. of Germany

[73] Assignee: Rheinmetall GmbH, Düsseldorf, Fed. Rep. of Germany

[21] Appl. No.: 700,365

[22] Filed: May 9, 1991

[30] Foreign Application Priority Data

Jun. 29, 1990 [DE] Fed. Rep. of Germany ..... 4020673

[51] Int. Cl.[5] ..... F41F 1/04

[52] U.S. Cl. ..... 89/7

[58] Field of Search ..... 89/7

[56] References Cited

U.S. PATENT DOCUMENTS

| | | | |
|---|---|---|---|
| 4,023,463 | 5/1977 | Tassie | 89/7 |
| 4,341,147 | 7/1982 | Mayer | 89/7 |
| 4,523,507 | 6/1985 | Magoon | 89/7 |
| 4,586,422 | 5/1986 | Magoon | 89/7 |
| 4,693,165 | 9/1987 | Magoon et al. | 89/7 |
| 4,930,394 | 6/1990 | Zwingel et al. | 89/7 |
| 4,932,327 | 6/1990 | Bulman et al. | 89/7 |
| 4,934,242 | 6/1990 | Bulman | 89/7 |
| 4,949,621 | 8/1990 | Stephens | 89/7 |
| 4,993,310 | 2/1991 | Sackenreuter et al. | 89/7 |

*Primary Examiner*—David H. Brown

*Attorney, Agent, or Firm*—Spencer, Frank & Schneider

[57] ABSTRACT

A liquid propellant cannon includes an axially movable pump piston 25 which is exposed to propellant in a propellant chamber. The pump piston has a stroke that is shorter than the total length of the propellant chamber. For some or all of the rest of its length the propellant chamber 22 is divided by webs into parallel chamber portions. The pump piston causes uniform ignition of the liquid propellant charge during its relatively short stroke, while the chamber portions permit a substantially variation-free, compact reaction of the liquid propellant. The result is a relatively compact structure which provides uniform combustion behavior.

16 Claims, 3 Drawing Sheets

LIQUID PROPELLANT CANNON

BACKGROUND OF THE INVENTION

The present invention relates to a liquid propellant cannon.

A prior art liquid propellant cannon is shown schematically in FIG. 5, and includes a propellant chamber 100 disposed between a projectile 101 and a breechblock 102. The propellant is loaded according to the known "bulk loading system". According to this system, the liquid propellant is filled directly into the propellant chamber 100, which is configured as a combustion chamber. However, the reaction is uncontrolled because the interfaces determining the combustion fluctuate greatly. The bulk loading system is often employed for liquid propellant cannons of a relatively small caliber, with it being necessary, however, to consider the drawback of strong gas pressure variations.

Another prior art liquid propellant cannon is shown schematically in FIGS. 6 and 7. After a starter charge 92 has been ignited, the liquid propellant is injected according to the regenerative piston system by a pump piston 103 from a pump or propellant chamber 104 into a separate combustion or gas chamber 105. The controlled supply of liquid propellant in the regenerative piston system results in uniform combustion in the gas chamber 105.

The drawback in the regenerative piston system is that the head of the pump piston 103 approximately corresponds to the diameter of propellant chamber 104 and thus constitutes a comparatively large mass. This mass must be moved and decelerated over a stroke which has the length of the pump chamber.

SUMMARY OF THE INVENTION

It is an object of the present invention to make available a liquid propellant cannon in which a compact reaction of the liquid propellant is possible in the propellant chamber, resulting in uniform combustion behavior.

This and other objects which will become apparent in the ensuing detailed description can be attained by providing a liquid propellant cannon which is characterized in that an axially movable pump piston is disposed within a propellant chamber, with the stroke of the pump piston having a length that is shorter than the length of the propellant chamber and with at least some of the rest of the propellant chamber being divided into chamber portions which are arranged parallel to the bore axis of the gun barrel.

The present invention makes it possible to utilize the advantages of the regenerative piston principle in the starting phase of the liquid propellant cannon because the pump piston takes care of uniform ignition of the liquid propellant or primary charge over a comparatively short stroke. On the other hand, the chamber portions arranged parallel to the bore axis take care of a substantially oscillation free, compact reaction of the liquid propellant within the propellant chamber according to the bulk loading system.

Only a short starting length, for example only 20% of the propellant chamber length, is needed for the stroke of the pump piston, so that no special measures are required to decelerate the pump piston. The head diameter of the pump piston, according to one embodiment, does not exceed the sleeve diameter of the pump piston. According to another embodiment, the head diameter corresponds to the diameter of an annular member attached to the breechblock. In order to create the parallel chamber portions, the diameters of the sleeve and the breech are substantially smaller than the propellant chamber diameter, so that only small masses need be moved over a relatively short starting stroke and so that the liquid propellant cannon has a relatively light weight and small structural volume.

DESCRIPTION OF THE PREFERRED EMBODIMENTS

Figure 1:
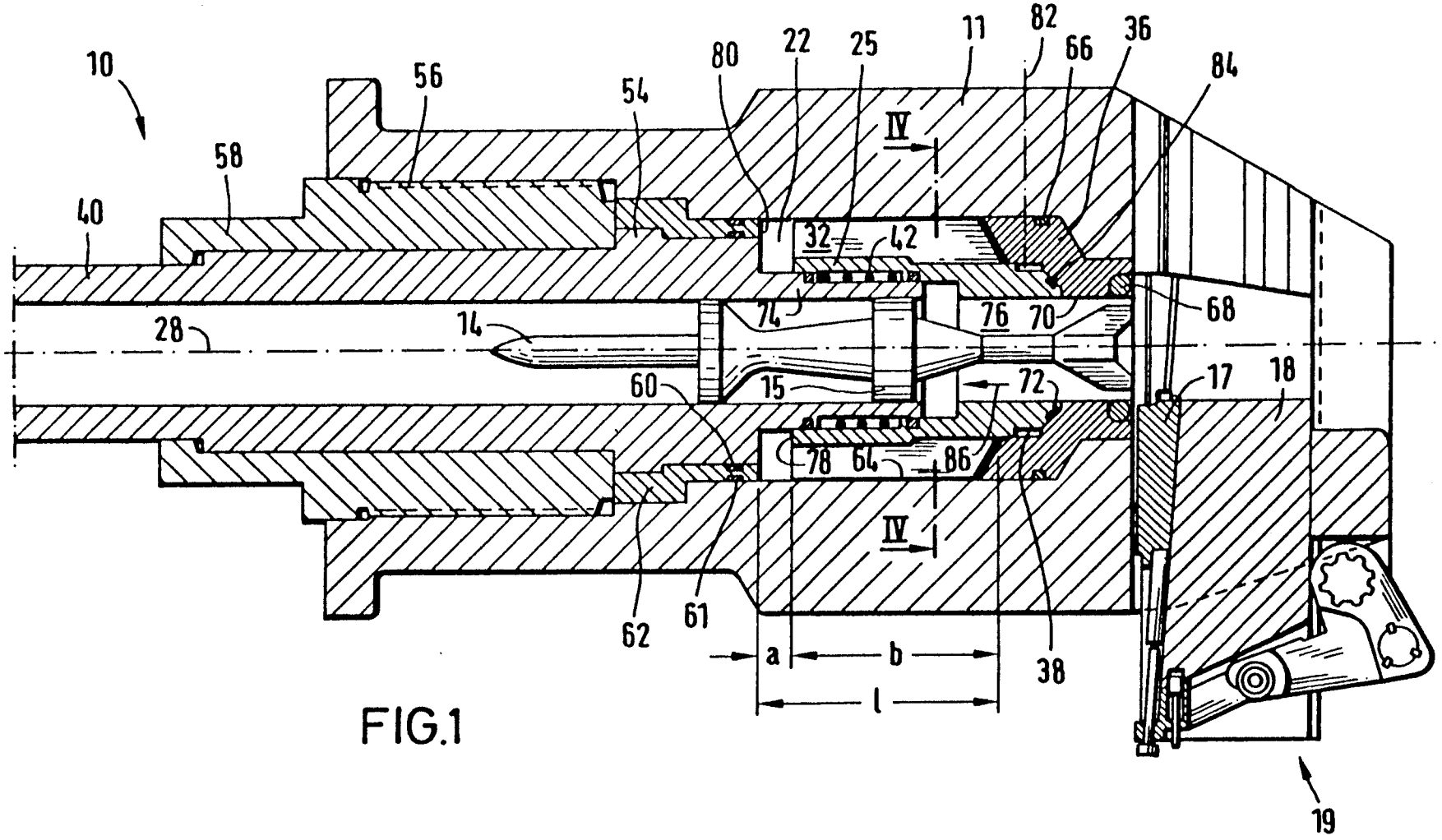
FIG. 1 is a longitudinal sectional view illustrating a portion of a large caliber liquid propellant cannon in accordance with an embodiment of the present invention.

FIG. 1 illustrates a large caliber liquid propellant cannon 10 in accordance with a first embodiment of the present invention. The cannon 10 has a gun barrel 40 which accommodates a subcaliber kinetic energy projectile 14 equipped with a large caliber sabot 15 of, for example, 120 mm caliber diameter, which has been introduced from the rear. In order to enable fastening in a breechblock housing 11, gun barrel 40 has multiple steps in its outer diameter as shown. A radially outwardly projecting attachment 54 serves to axially fix the gun barrel 40, in that a plug 58 which is screwed in into breechblock housing 11 by way of threads 56 pulls it against a stop sleeve 62.

Sleeve 62 includes seals 60 and 61 to seal off a propellant chamber 22, which has a length 1 and whose outer diameter is formed by a housing bore 64. Liquid propellant is introduced into propellant chamber 22 through valves (not shown).

A housing insert 36 is disposed in the rearward region of housing bore 64. The housing insert 36 is provided with an external seal 66 to seal off housing bore 64 and with an internal seal 68 to seal off a breechblock insert 17. The breechblock insert 17 and a breechblock 18 are initially moved by a drive 19 transversely to the bore axis 28 of the gun barrel 40 into a position behind the gun barrel, and then pressed axially against seal 68.

Housing insert 36 has a caliber-sized internal bore 70, followed by an abutment surface 72 for a pump piston 25. Pump piston 25 is supported on a gun barrel projection 74. When in a contacting position as shown, piston 25 isolates propellant chamber 22 from a combustion or gas chamber 76. Combustion chamber 76 is defined at the front by the sabot 15 of projectile 14 and at the rear by breechblock insert 17.

When the pump piston 25 is in the closed position as shown, its front end 78 is spaced a distance a behind the forward end 80 of propellant chamber 22. Forward end 80 is formed by radial faces of sleeve 62 and of gun barrel 40, thus permitting the pump piston 25 to perform an axial stroke of length a, which is only a fraction of the total propellant chamber length 1. The remainder of propellant chamber 22 has a length b.

Figure 4:
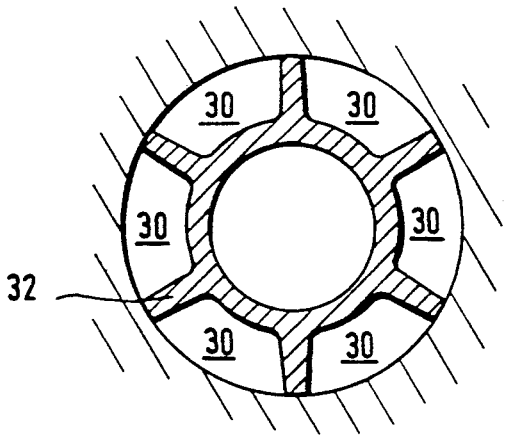
FIG. 4 is a cross-sectional view of the propellant chamber as seen along the lines marked IV—IV in FIG. 1.

FIG. 4 shows a cross section taken along Line IV—IV of FIG. 1, but without sabot 15 or projectile 14. As can be seen from FIGS. 1 and 4, the portion of propellant chamber 22 having length b is divided into chamber portions 30, which are arranged parallel to gun barrel bore axis 28. Chamber portions 30 are uniformly distributed over the circumference of propellant chamber 22 and are separated from one another by radially extending webs 32 fastened on the circumference of pump piston 25.

Between pump piston 25 and the housing insert 36, there is provided an antechamber 38. This antechamber 38 is filled with liquid propellant, in a manner not shown, at the location 82 marked in dot-dash lines. In a known manner, this liquid propellant can be electrically ignited to fire a shot. Antechamber 38 is sealed against combustion chamber 76 by a seal 84 fastened on pump piston 25.

Pump piston 25 has a sleeve-like shape and accommodates a recuperator spring 42, which is supported on the projection 74 of gun barrel 40.

When pump piston 25 undergoes a stroke through the distance a, the pumped volume of liquid propellant corresponds to the thickness of the sleeve portion of piston 25 times its circumference times the distance a.

The electrical ignition of the liquid propellant disposed in antechamber 38 causes pump piston 25 to be moved in the direction of arrow 86, and propellant chamber 22 is opened toward combustion chamber 76. In this first phase, the movement of pump piston 25 into propellant chamber 22 transports the above-described volume of liquid propellant toward combustion chamber 76, causing a controlled combustion to be initiated by the liquid propellant ignited in antechamber 38.

During the stroke of pump piston 25, the liquid propellant flowing out of propellant chamber 22 into combustion chamber 76 causes uncontrolled penetration of the flame front initiated by the starter charge into propellant chamber 22.

After pump piston 25 has been stopped, the portion of the liquid propellant still disposed in chamber portions 30 is reacted separately. There may, for example be six chamber portions 30, each having a length b of, for example, 80% of the total propellant chamber length 1. The division of part of propellant chamber 22 into long chamber portions 30 permits individual irregularities of the reaction taking place in the chamber portions 30 to be lost in the total number of reactions. That is, the various gas pressure developments act on projectile 14 and the remaining components of the weapon only with an average gas pressure.

It should be noted from FIG. 1 that the region in which recuperator spring 42 is mounted is protected by seals (shown but not numbered), thereby preventing high-pressure detonation gasses from entering this region. This facilitates the opening movement of pump piston 25.

After a shot has been fired, recuperator spring 42 will move pump piston 25 back into its closed position and thus make propellant chamber 22 ready for a new filling process through valves (not shown).

Figure 2:
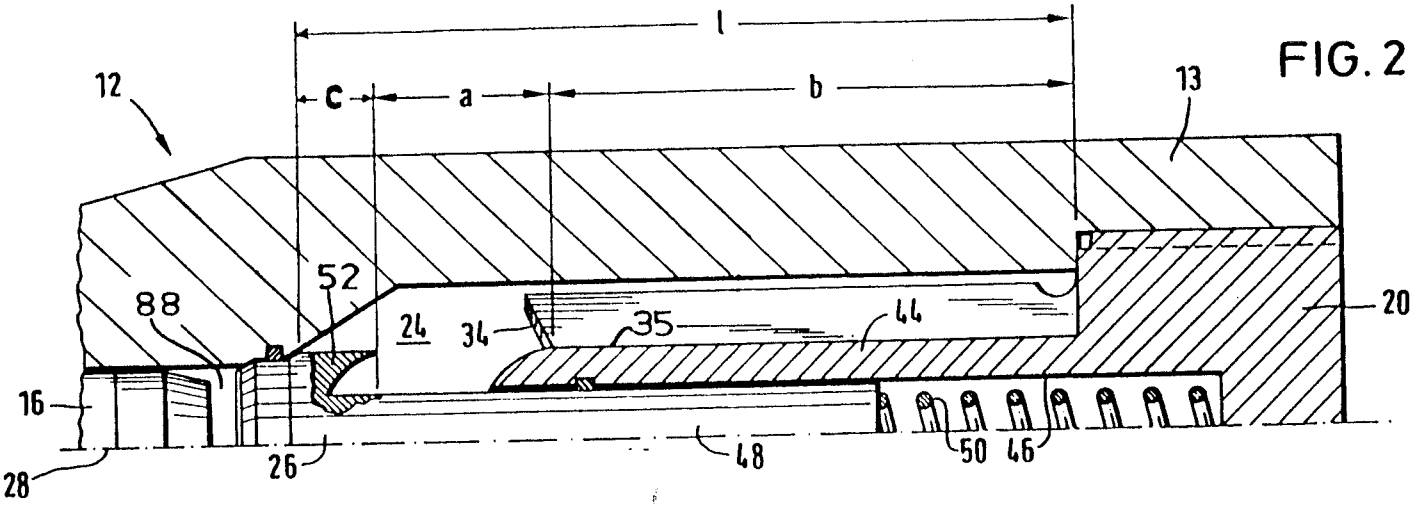
FIG. 2 is a longitudinal sectional view illustrating a portion of a small caliber liquid propellant cannon in accordance with another embodiment before the start.
Figure 3:
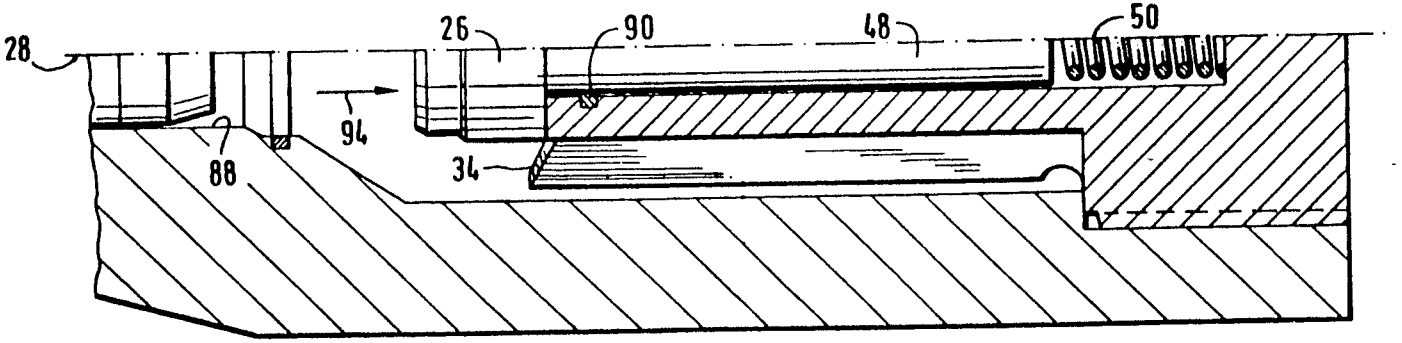
FIG. 3 is a longitudinal sectional view showing the liquid propellant cannon of FIG. 2 after the start.

The further embodiment shown in FIGS. 2 and 3 illustrates the use of the invention, for example, for a small caliber liquid propellant cannon 12.

In contrast to the embodiment shown in FIG. 1, projectile 16 is not surrounded by the propellant chamber. Instead, projectile 16 is disposed ahead of propellant chamber 24 in the gun barrel. The propellant chamber 24 is provided in a breechblock housing 13 and is closed at the tail end thereof by a breechblock 20 screwed into housing 13. The other end of propellant chamber 24 is initially closed by a pump piston 26, as shown in FIG. 2. The total length of propellant chamber 24 is designated 1 in FIG. 2.

A caliber-sized charge chamber 88 is provided behind projectile 16.

Pump piston 26 is mounted so as to be axially movable for a stroke of distance a. For this purpose, pump piston 26 includes a piston rod 48 which extends into a bore 46 in an annular member 44 that is connected with breechblock 20.

Webs 34 have bases 35 that are attached to member 44 at positions uniformly distributed over its circumference. Bases 35 have a length designated by b in FIG. 2. The webs 34 divide the portion of propellant chamber 24 that surrounds member 44 into elongated chamber portions. There may, for example, be six webs 34 arranged in a manner similar to that shown in FIG. 4, resulting in six chamber portions having the length b.

The internal bore 46 is sealed from propellant chamber 24 by a sealing ring 90 (see FIG. 3) so that atmospheric pressure may exist in the bore. Within bore 46, a compression spring 50 is provided to return pump piston 26 to its starting position.

Pump piston 26 includes a piston head 52 which has a diameter that is larger than piston rod 48 and significantly smaller than propellant chamber 24, corresponding, for example, to the outer diameter of annular member 44. Thus, when the pump piston 26 undergoes a stroke, the pumping volume corresponds to the stroke distance a times the difference in the cross sectional areas of piston head 52 and piston rod 48.

Figure 5:
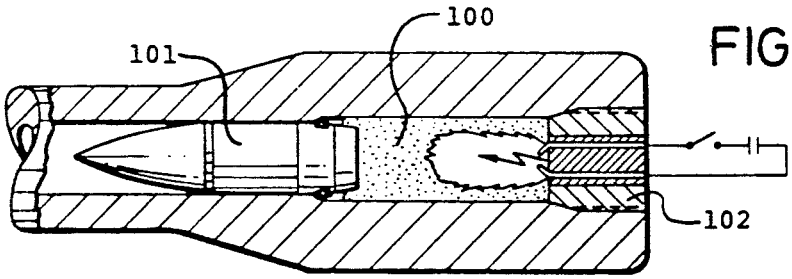
FIG.5 (PRIOR ART)
FIG. 5 is a longitudinal sectional view showing part of a liquid propellant cannon operating according to the bulk loading system.
Figure 6:
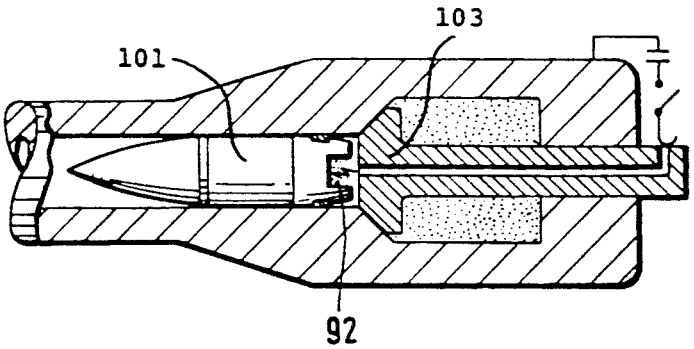
FIG.6 (PRIOR ART)
FIG. 6 is a longitudinal sectional view showing part of a liquid propellant cannon operating according to the regenerative piston system before the start.
Figure 7:
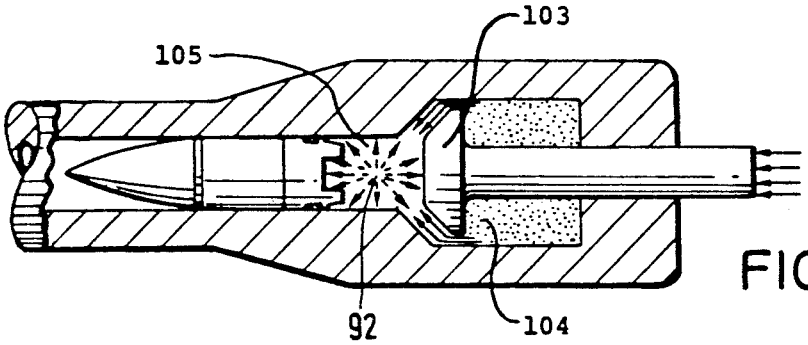
FIG.7 (PRIOR ART)
FIG. 7 shows the liquid propellant cannon of FIG. 6 after the start.

The starting stroke of pump piston 26 takes place after the electrical ignition of a starter charge which is disposed in charge chamber 88. The piston stroke causes liquid propellant to be injected, according to the regenerative piston principle previously discussed with reference to FIGS. 5 and 6, from propellant chamber 24 into the expanding charge chamber 88 for further ignition.

The resulting pressure difference forces pump piston 26 back in the direction of arrow 94. This permits the flame front to advance into the elongated chamber portions provided by webs 34, and the same combustion process as described in connection with the embodiment of FIG. 1 produces a compact reaction of the received liquid propellant with the least possible variations in the driving pressure in chamber 88.

In the embodiment of FIGS. 2 and 3, the stroke length a plus the length b of the chamber portions is less than the total length 1 of propellant chamber 24. The difference corresponds to the distance c by which pump head 52 extends into propellant chamber 52 before the piston stroke begins.

It will be understood that the above description of the present invention is susceptible to various modifications, changes, and adaptations, and the same are intended to be comprehended within the meaning and range of equivalents of the appended claims.

What is claimed is:

1. A liquid propellant cannon, comprising:

a barrel having a bore with a bore axis;

means connected to the barrel for providing a propellant chamber, the propellant chamber having a first portion with a first length and a second portion with a second length and a circumference, the propellant chamber having a total length that is at least as greater as the sum of the first and second lengths;

a pump piston which is exposed to propellant in the propellant chamber, the pump piston being mounted for movement along a stroke path having a length that is the same as the first length; and means for dividing the second portion of the propellant chamber into a plurality of chamber portions that are parallel to the bore axis and that are arranged in uniform distribution along the circumference of the second portion of the propellant chamber, the means for dividing including a plurality of radially extending webs.

2. The cannon of claim 1, wherein a breech is provided behind the barrel, and wherein the means for providing a propellant chamber comprises a breechblock housing mounted on the barrel and a housing insert mounted on the breechblock housing, and wherein at least one of the housing insert and the pump piston has a recess providing an antechamber for receiving electrically ignitable propellant, the antechamber being located closer to the breech than the barrel.

3. The cannot of claim 2, wherein the antechamber is disposed between the housing insert and the pump piston.

4. The cannon of claim 1, wherein the means for providing a propellant chamber comprises a breechblock housing mounted on the barrel and a housing insert mounted on the breechblock housing, and wherein the housing insert and pump piston have adjacent surface regions that are configured to provide an antechamber, between the housing insert and the pump piston, to receive liquid propellant.

5. The cannon of claim 4, further comprising a breechblock behind the barrel, and wherein the antechamber is located closer to the breechblock than the barrel.

6. A liquid propellant cannon, comprising:

a barrel having a bore with a bore axis;

means connected to the barrel for providing a propellant chamber, the propellant chamber having a first portion with a first length and a second portion with a second length, the propellant chamber having a total length that is at least as great as the sum of the first and second lengths;

a pump piston which is exposed to propellant in the propellant chamber, the pump piston being mounted for movement along a stroke path having a length that is the same as the first length, the pump piston having a periphery; and means for dividing the second portion of the propellant chamber into a plurality of chamber portions that are parallel to the bore axis, the means for dividing including radial webs fastened to the periphery of the pump piston.

7. The cannon of claim 6, wherein the means for providing a propellant chamber comprises a breechblock housing mounted on the barrel and a housing insert mounted on the breechblock housing, and wherein the housing insert and pump piston have adjacent surface regions that are configured to provide an antechamber, between the housing insert and the pump piston, to receive liquid propellant.

8. The cannon of claim 7, further comprising a breechblock behind the barrel, and wherein the antechamber is located closer to the breechblock than the barrel.

9. A liquid propellant cannon, comprising:

a barrel having a bore with a bore axis;

means connected to the barrel for providing a propellant chamber, the propellant chamber having a first portion with a first length and a second portion with a second length, the propellant chamber having a total length that is at least as great as the sum of the first and second lengths;

a pump piston which is exposed to propellant in the propellant chamber, the pump piston being mounted for movement along a stroke path having a length that is the same as the first length, the pump piston including a sleeve portion;

means for dividing the second portion of the propellant chamber into a plurality of chamber portions that are parallel to the bore axis; and a recuperator spring accommodated in the sleeve portion of the pump piston, the recuperator spring pressing against the barrel.

10. The cannon of claim 9, wherein the sleeve portion of the pump piston has a predetermined cross-sectional area, and wherein the pump piston pumps a volume of propellant. corresponding to the cross-section area times the first distance when it moves along the stroke path.

11. The cannon of claim 9, wherein the means for providing a propellant chamber comprises a breechblock housing mounted on the barrel and a housing insert mounted on the breechblock housing, and wherein the housing insert and pump piston have adjacent surface regions that are configured to provide an antechamber, between the housing insert and the pump piston, to receive liquid propellant.

12. The cannon of claim 11, further comprising a breechblock behind the barrel, and wherein the antechamber is located closer to the breechblock than the barrel.

13. A liquid propellant cannon, comprising:

a barrel having a bore with a bore axis;

means, including a breechblock housing connected to the barrel and a breechblock which is received by the breechblock housing, for providing a propellant chamber, the propellant chamber having a first portion with a first length and a second portion with a second length, the propellant chamber having a total length that is at least as great as the sum of the first and second lengths;

a pump piston which is exposed to propellant in the propellant chamber, the pump piston being mounted for movement along a stroke path having a length that is the same as the first length;

an annular member connected to the breechblock; and means for dividing the second portion of the propellant chamber into a plurality of chamber portions that are parallel to the bore axis, the means for dividing including webs having elongated bases with lengths that are approximately equal to the second length, the webs being mounted at their bases on the annular member.

14. The cannon of claim 13, wherein the annular member has a central bore, and wherein the pump piston comprises a piston rod which movably extends within the central bore of the annular member.

15. The cannon of claim 14, further comprising a compression spring within the central bore of the annular member, the compression spring pressing against the piston rod.

16. The cannon of claim 14, wherein the propellant chamber has a predetermined maximum diameter, wherein the pump piston further comprises a piston head connected to the piston rod, the piston head having a diameter larger than that of the piston rod but substantially smaller than the maximum diameter of the propellant chamber, and wherein the pump piston pumps a volume of propellant corresponding to the difference in the cross sectional areas of the piston rod and the piston head times the first distance when it moves along the stroke path.

* * * * *